US011693361B2

(12) United States Patent
Tanaka et al.

(10) Patent No.: US 11,693,361 B2
(45) Date of Patent: Jul. 4, 2023

(54) IMAGE FORMING APPARATUS INCLUDING BLOWER UNIT

(71) Applicant: CANON KABUSHIKI KAISHA, Tokyo (JP)

(72) Inventors: Masashi Tanaka, Kanagawa (JP); Shingo Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/842,533

(22) Filed: Jun. 16, 2022

(65) Prior Publication Data

US 2022/0308524 A1 Sep. 29, 2022

Related U.S. Application Data

(63) Continuation of application No. 17/325,044, filed on May 19, 2021, now Pat. No. 11,402,799.

(30) Foreign Application Priority Data

May 28, 2020 (JP) ..... 2020-093508

(51) Int. Cl.
*G03G 15/20* (2006.01)
*G03G 21/20* (2006.01)

(52) U.S. Cl.
CPC ..... *G03G 21/206* (2013.01); *G03G 15/205* (2013.01); *G03G 15/2028* (2013.01); *G03G 15/2064* (2013.01)

(58) Field of Classification Search
CPC ..... G03G 21/206; G03G 15/2064; G03G 15/205; G03G 15/2028
See application file for complete search history.

(56) References Cited

FOREIGN PATENT DOCUMENTS

JP 2006317512 A * 11/2006
JP 5858611 B2 2/2016

* cited by examiner

*Primary Examiner* — Sevan A Aydin
(74) *Attorney, Agent, or Firm* — Canon U.S.A., Inc. I.P. Division

(57) ABSTRACT

An image forming apparatus for forming a toner image on a recording material includes a fixing unit and a blower unit to blow air around a roller. The fixing unit includes a tubular shape film, a heating member disposed in a space surrounded by the film, and the roller forming a nip portion with the heating member. The fixing unit heats and fixes the toner image onto the recording material at the nip portion. For printing that forms toner images on continuously conveyed recording materials where a roller surface temperature is lower than a predetermined temperature, fan stop and operation periods are set. During the fan stop period, the blower unit is stopped and an interval between preceding and subsequent recording materials is widened. During the fan operation period, the blower unit is in operation and the interval is narrower than the interval during the fan stop period.

28 Claims, 6 Drawing Sheets

TRANSITION OF PRESSING ROLLER TEMPERATURE

IMAGE FORMING APPARATUS INCLUDING BLOWER UNIT

CROSS-REFERENCE TO RELATED APPLICATIONS

The present application is a continuation of U.S. patent application Ser. No. 17/325,044, filed on May 19, 2021, which claims priority from Japanese Patent Application No. 2020-093508 filed May 28, 2020, which are hereby incorporated by reference herein in their entireties.

BACKGROUND

Field of the Invention

The present disclosure relates to an image forming apparatus, such as printer including a laser printer, a light-emitting diode (LED) printer, a digital copying machine and the like, that forms a toner image on a recording material using the electrophotographic method or the electrostatic recording method.

Description of the Related Art

A fixing unit that fixes a toner image onto a recording material is mounted on an image forming apparatus using the electrophotographic method or the electrostatic recording method. A fixing unit among different types of fixing units uses a film heating method employing a tubular fixing film. The fixing unit using the film heating method includes a tubular fixing film, a heater disposed in a space surrounded by the fixing film, and a pressing roller that forms a fixing nip portion with the heater while the fixing film is held between the pressing roller and the heater. The fixing unit using the film heating method is low in heat capacity, and thus can shorten a time to raise the temperature of the fixing unit to a toner image fixing temperature. Since the temperature can be raised in a short time, the fixing unit does not have to be warmed while being on standby, and consequently power consumption can be reduced at a low level.

Most of the fixing units using the film heating method have a configuration in which the fixing film rotates by being driven by rotation of the pressing roller. Thus, when a conveyance force of the pressing roller falls below frictional resistance between the heater and an inner surface of the fixing film, the fixing film slips. This causes a failure in conveyance of the recording material. Especially, when the fixing processing is performed on a toner image on a recording material containing moisture absorbed therein under a high-humidity environment in a state that the temperature of the heater rises to the toner image fixing temperature by the warm-up but the pressing roller is not sufficiently warmed, water vapor from the recording material at the fixing nip portion is condensed on the surface of the pressing roller. This condensation reduces the conveyance force of the pressing roller, and consequently slipping may occur. The slipping due to condensation on the pressing roller will be referred to as condensation slipping. Especially when continuous printing is performed in the state that the fixing unit is yet to be warmed up, the pressing roller is easily deprived of heat by the sheet and is subjected to a temperature drop, and consequently the condensation slipping may occur.

To prevent the condensation slipping, Japanese Patent Application Laid-Open No. 2006-317512 widens a distance between a preceding recording material and a subsequent recording material at the time of the continuous printing (hereinafter referred to as an interval) when a temperature of the pressing roller is low. According to the configuration, the pressing roller is warmed with heat from the fixing film to raise a temperature of the pressing roller during the intervals, to prevent or reduce condensation. However, widening the interval to prevent condensation slipping undesirably leads to a reduction in the printing productivity. According to the technique discussed in Japanese Patent No. 5858611, a humidity around a pressing roller is reduced using a cooling fan, to prevent condensation on the pressing roller.

If a printing speed further increases as improvements in performances of image forming apparatuses, one conceivable measure therefor is to increase outer diameters of a fixing film and a pressing roller. This measure aims to increase a width of the fixing nip portion to adapt to the increasing speed but undesirably causes an increase in a frictional resistance between the fixing film and a heater. Further, since components, such as the pressing roller, are enlarged, the heat capacity is also increased, and consequently it takes time to raise a pressing roller temperature. This necessitates a further wide setting of the interval to prevent an occurrence of condensation slipping under the high-humidity environment as described above.

Further, continuous printing requires the interval to be kept widened to prevent the pressing roller temperature from being lowered, and thus requires a further high-speed operation to improve printing productivity.

Another possible means is to dehumidify a vicinity of the pressing roller using a cooling fan to prevent condensation as described above, to improve printing productivity without speeding up a printing operation as much as possible. However, because a temperature of the pressing roller drops due to cooling air, the amount of curling in a sheet may increase after fixing. If dehumidification is performed using a fan while the pressing roller is cooled down, the temperature of the pressing roller drops. This causes a large temperature difference between the fixing film and the pressing roller. A recording material is slightly shrunk when moisture is evaporated during heating fixing. When a temperature difference between a front side and a back side of a recording material is large, the recording material is undesirably shrunk at a different shrinkage ratio between the front side and the back side, which leads to an increase in the amount of curling in the recording material. Generally, moisture moves to a lower-temperature side, and thus the recording material has a higher moisture content on the low-temperature pressing roller side than on the high-temperature film side in the thickness direction of the recording material. Accordingly, the recording material after heating fixing is curled in a manner such that the pressing roller side of the recording material is shrunk, because the greater amount of moisture is evaporated on the pressing roller side. When continuous printing is performed, large curling on a recording material impairs smoothness of stacking and smoothness of alignment of each recording material on a sheet discharge unit. This leads to difficulty in handling of recording materials.

SUMMARY

According to an aspect of the present disclosure, an image forming apparatus for forming a toner image on a recording material, the image forming apparatus includes a fixing unit including a film in a tubular shape, a heating member disposed in a space surrounded by the film, and a roller forming a fixing nip portion together with the heating member via the film, wherein the fixing unit is configured to heat and fix the toner image formed on the recording material onto the recording material at the fixing nip portion, and a blower unit configured to blow air around the roller, wherein, in a case of continuous printing that forms toner images on a plurality of continuously conveyed recording materials in a state that a surface temperature of the roller is lower than a predetermined temperature, a fan stop period and a fan operation period are set, wherein, during the fan stop period, the blower unit is stopped and an interval between a preceding recording material and a subsequent recording material is widened, and wherein, during the fan operation period, the blower unit is in operation and the interval is narrower than the interval during the fan stop period.

Further features of the present disclosure will become apparent from the following description of exemplary embodiments with reference to the attached drawings.

DESCRIPTION OF THE EMBODIMENTS

In the following description, a first exemplary embodiment of the present disclosure will be described. An image forming apparatus according to the present exemplary embodiment is an image forming apparatus having a fixing unit using the film heating method, which takes a short time to raise a temperature of the fixing unit to a fixing temperature. The image forming apparatus also has a cooling fan, and an interval and an operation of the cooling fan at the time of continuous printing is controlled, to prevent or reduce curling of a recording material and improve productivity for a printed product while a conveyance failure due to condensation on a pressing roller is prevented or reduced. First, the configuration of the main body of the image forming apparatus according to the present exemplary embodiment will be described, and, next, an interval between recording materials and control of the cooling fan relating to the present exemplary embodiment will be described in detail.

(Overall Configuration of Image Forming Apparatus)

Figure 6:
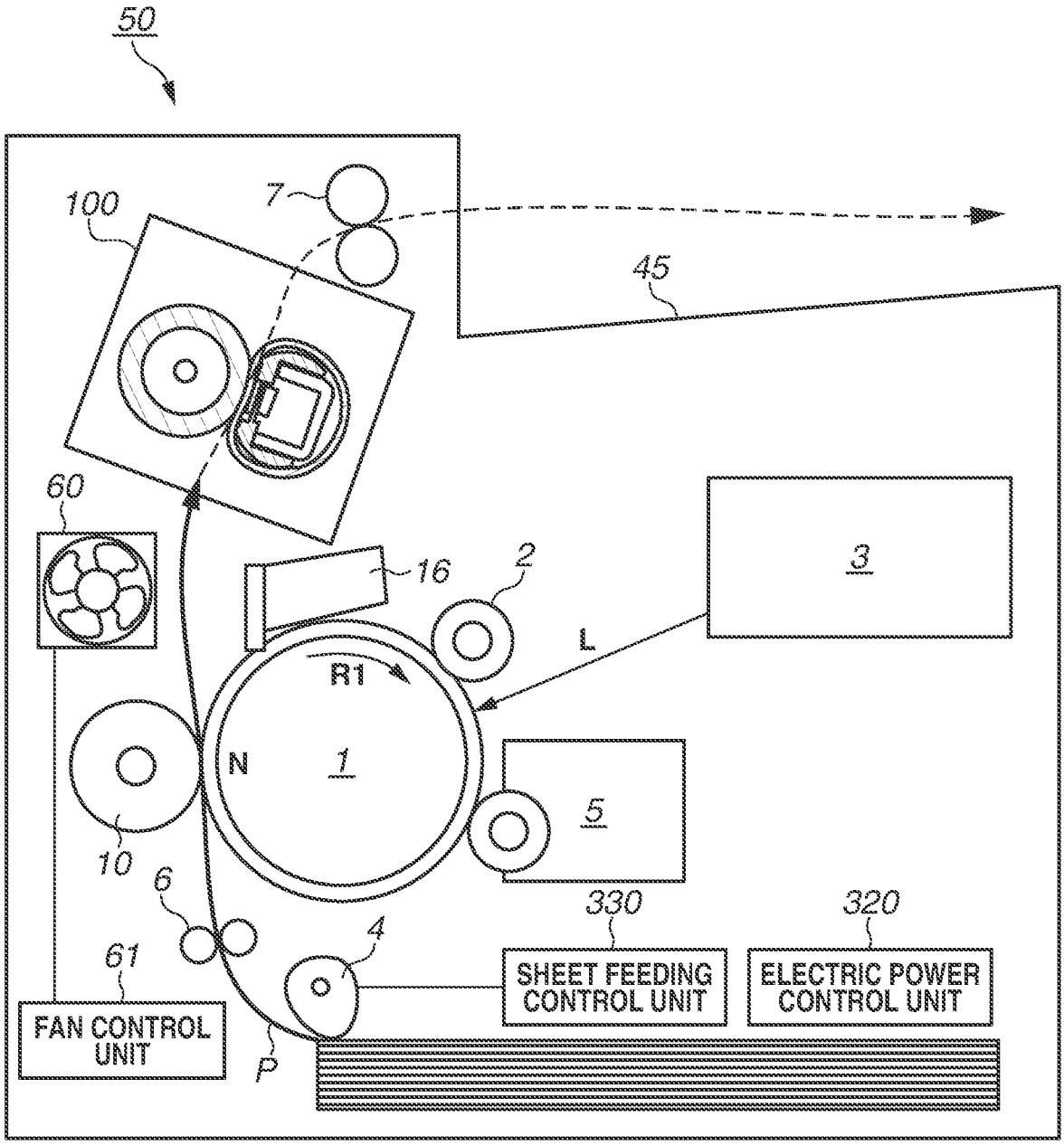
FIG. 6 is a diagram illustrating the configuration of an image forming apparatus.

FIG. 6 is a cross-sectional view of an image forming apparatus 50 according to the present exemplary embodiment. The image forming apparatus 50 is a laser beam printer that employs the electrophotographic method. The image forming apparatus 50 includes a photosensitive drum 1. A charging device 2, a laser scanner 3, a development device 5, a transfer roller 10, and a cleaner 16 are disposed on the circumferential surface of the photosensitive drum 1 in this order along a rotational direction (a direction indicated by an arrow R1).

The surface of the photosensitive drum 1 is charged by the charging device 2 to become negative in polarity. Next, the charged photosensitive drum 1 is scanned by the laser scanner 3, which emits laser light L according to image information, and an electrostatic latent image is formed on the surface of the photosensitive drum 1 (the surface potential increases on the exposed portion). Toner used by the image forming apparatus 50 is charged to become negative in polarity. The negatively charged toner is attached only to the portion corresponding to the electrostatic latent image on the photosensitive drum 1 by the development device 5 containing black toner, and a toner image according to the image information is formed on the photosensitive drum 1. Meanwhile, a recording material P is fed by a sheet feeding roller 4 prior to the process of forming the electrostatic latent image on the photosensitive drum 1. A sheet feeding control unit 330 controls a sheet feeding timing in such a manner that a leading edge of a toner image on the photosensitive drum 1 reaches a transfer nip portion N and a leading edge of a recording material P reaches the transfer nip portion N at timings synchronized with each other.

When the recording material P reaches the transfer nip portion N, a transfer bias positive in polarity, which is the opposite polarity from the charging polarity of the toner, is applied from a not-illustrated electric power source to the transfer roller 10. Due to the applied bias, the toner image on the photosensitive drum 1 is transferred onto the recording material P at the transfer nip portion N. The photosensitive drum 1 after the transfer is cleaned by the cleaner 16. The recording material P with the toner image formed thereon is conveyed to a fixing unit 100 and is subjected to heating fixing processing. The recording material P on which the toner image has been fixed is discharged onto a sheet discharge tray 45 by a sheet discharge roller 7.

In a continuous printing operation, in which toner images are formed on a plurality of continuously conveyed recording materials P, the next recording material P starts being fed in the middle of transfer of a toner image on the photosensitive drum 1 onto the preceding recording material P.

Prior to a timing at which a leading edge of the subsequent sheet reaches the transfer nip portion N, a process of forming an electrostatic latent image on the surface of the photosensitive drum 1 is also started, and a toner image for the subsequent sheet is formed on the photosensitive drum 1. Then, when the leading edge of the subsequent sheet reaches the transfer nip portion N, the toner image is transferred onto the subsequent sheet. The continuous printing is performed by repeating the above-described procedure.

Regarding a printing speed of the image forming apparatus 50 according to the present exemplary embodiment, the surface of the photosensitive drum 1 moves at a speed of approximately 258 mm/sec, and the image forming apparatus 50 can print up to 50 sheets having a letter (LTR) size per minute when performing the continuous printing.

(Cooling Fan (Blower Unit))

The image forming apparatus 50 according to the present exemplary embodiment includes a cooling fan 60 for lowering temperatures of the cleaner 16 and the photosensitive drum 1 and for lowering a humidity around the fixing unit 100 as described above. When the printing operation is repeated, the temperatures of the cleaner 16 and the photosensitive drum 1 rise due to heat from the fixing unit 100. If the temperatures exceed a softening point of toner, waste toner in the cleaner 16 may be hardened and toner in the development device 5 may be fused. When such a situation arises, a cleaning failure and a development failure occur on the photosensitive drum 1.

The image forming apparatus 50 according to the present exemplary embodiment actuates the cooling fan 60 by a fan control unit 61 to prevent or reduce an occurrence of the cleaning failure and the development failure, when the printing operation is repeated and the temperature in the image forming apparatus 50 rises.

The cooling fan 60 according to the present exemplary embodiment includes an air path for generating an air current around the pressing roller to prevent or reduce condensation on the pressing roller as described above. When the cooling fan 60 is actuated by the fan control unit 61, water vapor due to the heating fixing processing can be moved from around the pressing roller. This configuration allows the image forming apparatus 50 to prevent or reduce the condensation on the surface of the pressing roller, and thus the condensation slipping can be prevented.

The cooling fan 60 according to the present exemplary embodiment is configured in such a manner that air is applied to the surface of the photosensitive drum 1 at an air volume of 0.12 msec and to the surface of the pressing roller at an air volume of 0.06 msec when the cooling fan 60 is actuated by the fan control unit 61. When the printing operation is performed many times, the temperature of the photosensitive drum 1 rises. Thus, the image forming apparatus 50 actuates the cooling fan 60 to cool the vicinity of the photosensitive drum 1, to prevent or reduce an occurrence of the cleaning failure and the development failure. The control of the cooling fan 60 with the pressing roller in a cooled state, which is the characteristic of the present exemplary embodiment, will be described in detail below.

(Fixing Unit)

Figure 1:
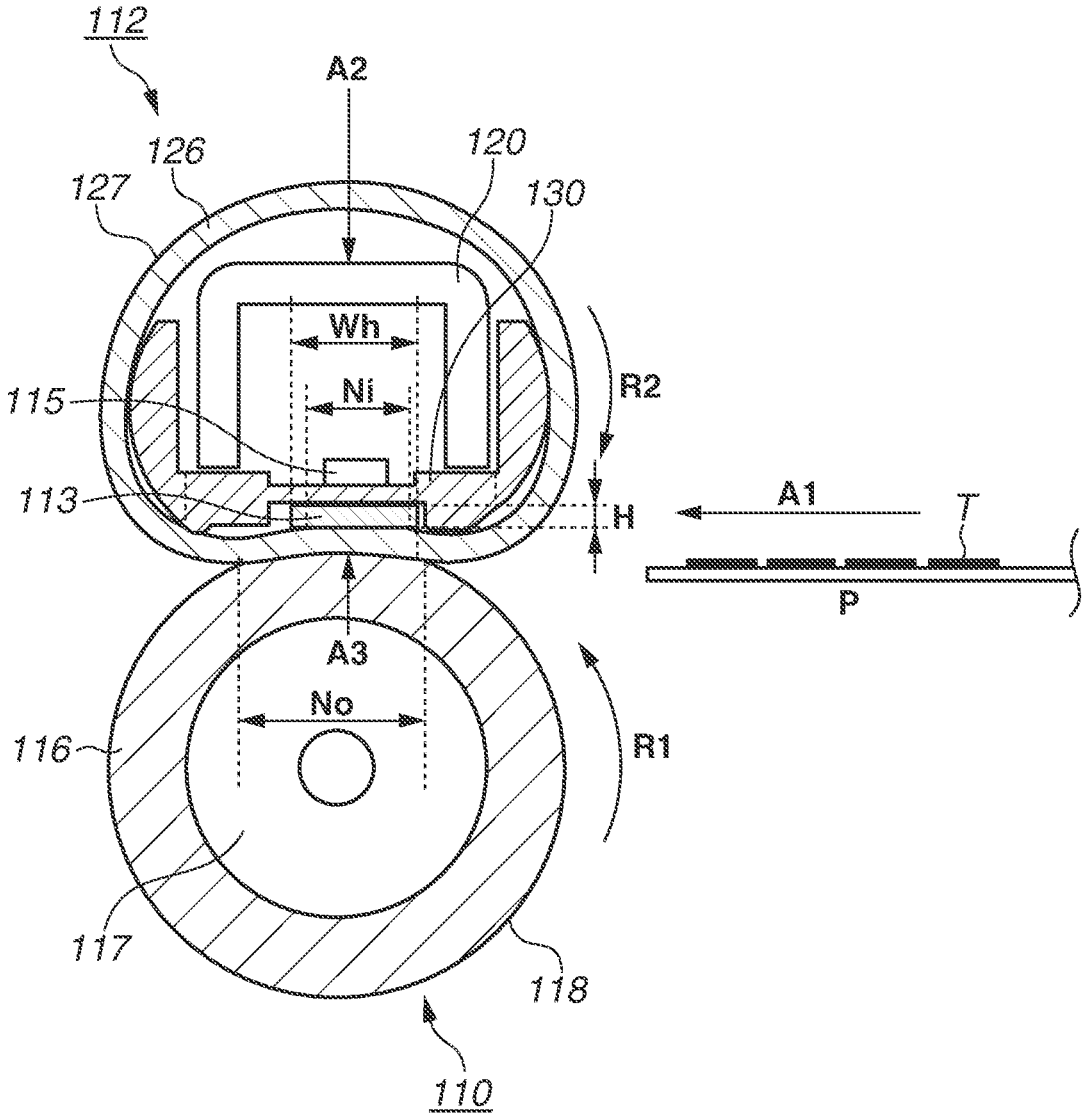
FIG. 1 is a cross-sectional diagram illustrating a fixing unit.

Next, the overview of the fixing unit 100 will be described. The fixing unit 100 is the fixing unit 100 using the film heating method for shortening the rise time and saving electric power consumption. FIG. 1 illustrates a cross-sectional view of the fixing unit 100 according to the present exemplary embodiment.

As illustrated in FIG. 1, the fixing unit 100 is configured in such a manner that a heater 113 is held by a heater holder 130, and a fixing film 112 in a tubular shape is rotatably provided around the heater 113 and the heater holder 130. Desirably, the material of the heater holder 130 is low in heat capacity to prevent the heater holder 130 from depriving the heater 113 of heat. In the present exemplary embodiment, liquid crystal polymer (LCP) which is heat-resistant resin is used. The heater holder 130 is supported by an iron stay 120 for ensuring the strength from the opposite side of the heater 113. A heating member disposed in a space surrounded by the fixing film 112 includes the heater 113, the heater holder 130, and the stay 120. As illustrated in FIG. 1, the stay 120 is pressed by pressing springs (not illustrated) in a direction indicated by an arrow A2 in FIG. 1 from the both end portions in the axial direction of a pressing roller 110 (i.e., the direction perpendicular to the paper of FIG. 1=the longitudinal direction of the fixing unit 100). As illustrated in FIG. 1, the heater 113 forms an inner surface nip portion Ni by coming into contact with the inner surface of the fixing film 112, and heats the fixing film 112 from inside. The pressing roller 110 forms a fixing nip portion No together with the heating member via the fixing film 112. The pressing roller 110 is driven in a direction indicated by an arrow R1 by receiving a driving force from a not-illustrated driving source. When the pressing roller 110 is driven in the direction indicated by the arrow R1, the fixing film 112 receives a driving force from the pressing roller 110 at the fixing nip portion No, and thus the fixing film 112 is rotationally driven in a direction indicated by an arrow R2.

When the recording material P with a toner image T formed thereon is conveyed in a direction indicated by an arrow A1 and introduced into the fixing nip portion No, the fixing unit 100 heats and fixes the toner image T formed on the recording material P onto the recording material P at the fixing nip portion No.

(Fixing Film)

The fixing film 112 is φ20 mm in outer diameter in a cylindrical shape, and has a multi-layered structure. The fixing film 112 includes a base layer 126 for maintaining the strength of the film, and a release layer 127 for reducing attachment of dirt or stain onto the surface. The base layer 126 should be heat-resistant because being subject to the heat of the heater 113, and should also be strong because slidably moves on the heater 113. For this reason, metal, such as stainless use steel (SUS) (stainless steel) and nickel, or heat-resistant resin, such as polyimide, can be desirably used as the material thereof. A metal material allows the base layer 126 to be thinned because being strong compared to resin and is also high in thermal conductivity, and thus the heat of the heater 113 can be easily transmitted to the surface of the fixing film 112. A resin material has an advantage of being low in heat capacity and being easily warmed because having low specific gravity compared to metal. The resin material can be molded at low cost because a thin film can be molded by coating molding. In the present exemplary embodiment, polyimide is used as the material of the base layer 126 of the fixing film 112, and a carbon-based filler is added to the base layer 126 to improve the thermal conductivity and the strength. As the thickness of the base layer 126 reduces, the heat of the heater 113 can be more easily transmitted to the surface of the pressing roller 110 but the strength reduces, and thus the thickness of the base layer 126 is desirably approximately 15 μm to 100 μm, and is set to 50 μm in the present exemplary embodiment.

Fluororesin, such as tetrafluoroethylene-perfluoroalkyl vinyl ether copolymer (perfluoroalkoxy alkane (PFA)), polytetrafluoroethylene (PTFE), tetrafluoroethylene-hexafluoropropylene (fluorinated ethylene propylene (FEP)), is desirably used as the material of the release layer 127 of the fixing film 112. PFA, which is highly releasable and highly heat-resistant among fluororesin materials, is used in the present exemplary embodiment. The release layer 127 may be a layer covering the surface with a tube but may also be a layer coating the surface with a coating material, and the release layer 127 is molded by the coating, which is excellent in molding a thin product, in the present exemplary embodiment. As the thickness of the release layer 127 reduces, the heat of the heater 113 can be more easily transmitted to the surface of the fixing film 112, but the durability reduces if the release layer 127 is excessively thin, so that the thickness of the release layer 127 is desirably approximately 5 μm to 30 μm, and is set to 10 μm in the present exemplary embodiment.

(Pressing Roller)

The pressing roller 110 is φ20 mm in outer diameter, and includes an elastic layer 116 (foamed rubber) that is a foamed silicon rubber of 4 mm in thickness, around an iron core metal 117 having a diameter of φ12 mm. If the pressing roller 110 is high in heat capacity and thermal conductivity, the heat on the surface of the pressing roller 110 would be easily absorbed inward, which leads difficulty in raising the surface temperature of the pressing roller 110. In other words, a material having as low heat capacity and low thermal conductivity as possible and capable of highly effectively insulating heat is more helpful to shorten the time taken to raise the surface temperature of the pressing roller 110. The thermal conductivity of the foamed rubber formed by foaming silicon rubber is 0.11 to 0.16 W/m·k, and is lower than solid rubber having thermal conductivity of approximately 0.25 to 0.29 W/m·k. The foamed rubber is also low in heat capacity, as the specific gravity regarding the heat capacity is approximately 0.45 to 0.85 for the foamed rubber while being approximately 1.05 to 1.30 for the solid rubber. Thus, the foamed rubber can shorten the time taken to raise the surface temperature of the pressing roller 110.

The outer diameter of the pressing roller 110 should be appropriately large because an excessively small diameter undesirably leads to a reduction in the width of the fixing nip portion No although a small outer diameter is helpful to reduce the heat capacity, and thus the out diameter is set to φ20 mm in the present exemplary embodiment. The thickness of the elastic layer 116 should also be appropriately thick because the heat would escape to the metallic core metal if the elastic layer 116 is excessively thin, and thus the thickness of the elastic layer 116 is set to 4 mm in the present exemplary embodiment. A release layer 118 made of PFA is formed on the elastic layer 116 as a release layer for the toner. The release layer 118 may be either a layer covering the surface with a tube or a layer coating the surface with a coating material similarly to the release layer 127 of the fixing film 112. A highly durable tube is used in the present exemplary embodiment. Besides PFA, fluororesin such as PTFE and FEP, highly releasable fluorine-contained rubber or silicon rubber, or the like may be used as the material of the release layer 118. The surface hardness of the pressing roller 110 is set to 40° measured by an Asker-C durometer (under a load of 4.9N) in the present exemplary embodiment, because excessively low hardness leads to a reduction in the durability although the width of the fixing nip portion No can be acquired with a low pressure as the surface hardness reduces. The pressing roller 110 is configured to rotate at approximately 258 msec equal to the surface movement speed of the photosensitive drum 1 in the direction indicated by the arrow R1 by a not-illustrated motor.

(Heater)

The heater 113 is a common heater that is used for fixing units using the film heating method, and is disposed by printing a heat generation resistor on a ceramic substrate. The heater 113 includes an alumina substrate having a width Wh=6 mm in the direction A1 as a recording material conveyance direction and a height H=1 mm. Then, the heater 113 is formed by coating the surface of the substrate with a silver/palladium (Ag/Pd) heat generation resistor with thickness of 10 μm by screen printing and covering it with glass thereon with a thickness of 50 μm as a heat generator protection layer. When electric power is supplied from a not-illustrated electrode unit, the heat generation resistor generates heat.

A temperature detection element 115 is disposed on the back surface of the heater 113. The temperature detection element 115 detects the temperature of the ceramic substrate rising with heat generated by the heat generation resistor. An electric power control unit 320 adjusts the temperature of the heater 113 at a temperature suitable for fixing toner by controlling electric power to be supplied to the heat generation resistor according to a signal of the temperature detection element 115.

The temperature detection element 115 also plays a role of detecting how much the fixing unit 100 is warmed. The fixing unit 100 is warmed when the heating fixing processing is performed along with one printing operation, and the temperature of the temperature detection element 115 also rises. When no printing operation is performed for a while after that, the fixing unit 100 is being cooled down and the temperature of the temperature detection element 115 is also dropping. Accordingly, the temperature detection element 115 can be used to detect how much the fixing unit 100 is warmed. Especially, when the printing operation is not performed for a while, a thermal equilibrium state is kept, which leads to a state where the detection temperature of the temperature detection element 115 and the temperature of the pressing roller 110 close to each other. Thus, it is possible to check whether the pressing roller 110 is cooled down and is in a state prone to an occurrence of the condensation slipping by detecting the temperature of the temperature detection element 115 before the printing operation.

(Setting of Interval and Control of Fan)

Next, the present exemplary embodiment will be further described focusing on the details of a setting of an interval between the preceding recording material and the subsequent recording material at the time of continuous printing, and control of a fan. The interval at the time of continuous printing can improve productivity by being set to as narrow interval as possible from the viewpoint of the productivity, but is advantageous when being set to a longer interval from the viewpoint of the condensation slipping because the pressing roller temperature can be easily warmed in the longer interval state.

The setting of the interval when the pressing roller 110 is in a warmed state where no condensation slipping occurs is set to the shortest possible setting (30 mm) in the present exemplary embodiment. A sheet feeding timing is controlled by the sheet feeding control unit 330 in such a manner that the interval is 30 mm at the time of the continuous printing. In the configuration of the image forming apparatus 50 according to the present exemplary embodiment, no condensation slipping occurs as long as the temperature of the pressing roller 110 before the printing operation is a predetermined temperature (65° C.) or higher. For this reason, the interval in a case where the temperature of the temperature detection element 115 before the printing operation is 65° C. or higher is set to be the shortest interval, which is 30 mm, in light of the productivity.

On the other hand, if the continuous printing is performed from a state that the pressing roller temperature falls below the predetermined temperature (65° C.), the pressing roller 110 is prone to condensation due to water vapor at the time of heating fixing for the preceding sheet. One conceivable measure in this case is to reduce the water vapor around the pressing roller 110 by actuating the cooling fan 60 as described above, but this measure causes a drop of the pressing roller temperature, which leads an increase in a temperature difference between the front and back faces of the sheet, and consequently curling of the recording material P increases. Thus, the present exemplary embodiment performs control of widening the interval to warm the pressing roller 110 in a case where the temperature of the temperature detection element 115 falls below 65° C. In this case, setting the interval to a distance equal to or longer than the whole circumference of the pressing roller 110 allows the pressing roller 110 to be easily warmed throughout the entire circumference thereof and thus prevent the condensation, and also prevents curling. The present exemplary embodiment performs control of widening the interval to 63 mm, which is approximately the length of the whole circumference (one cycle) of the pressing roller 110, in a case where the temperature of the temperature detection element 115 falls below 65° C. This control can prevent an increase in the curling and an occurrence of the condensation slipping.

Figure 2:
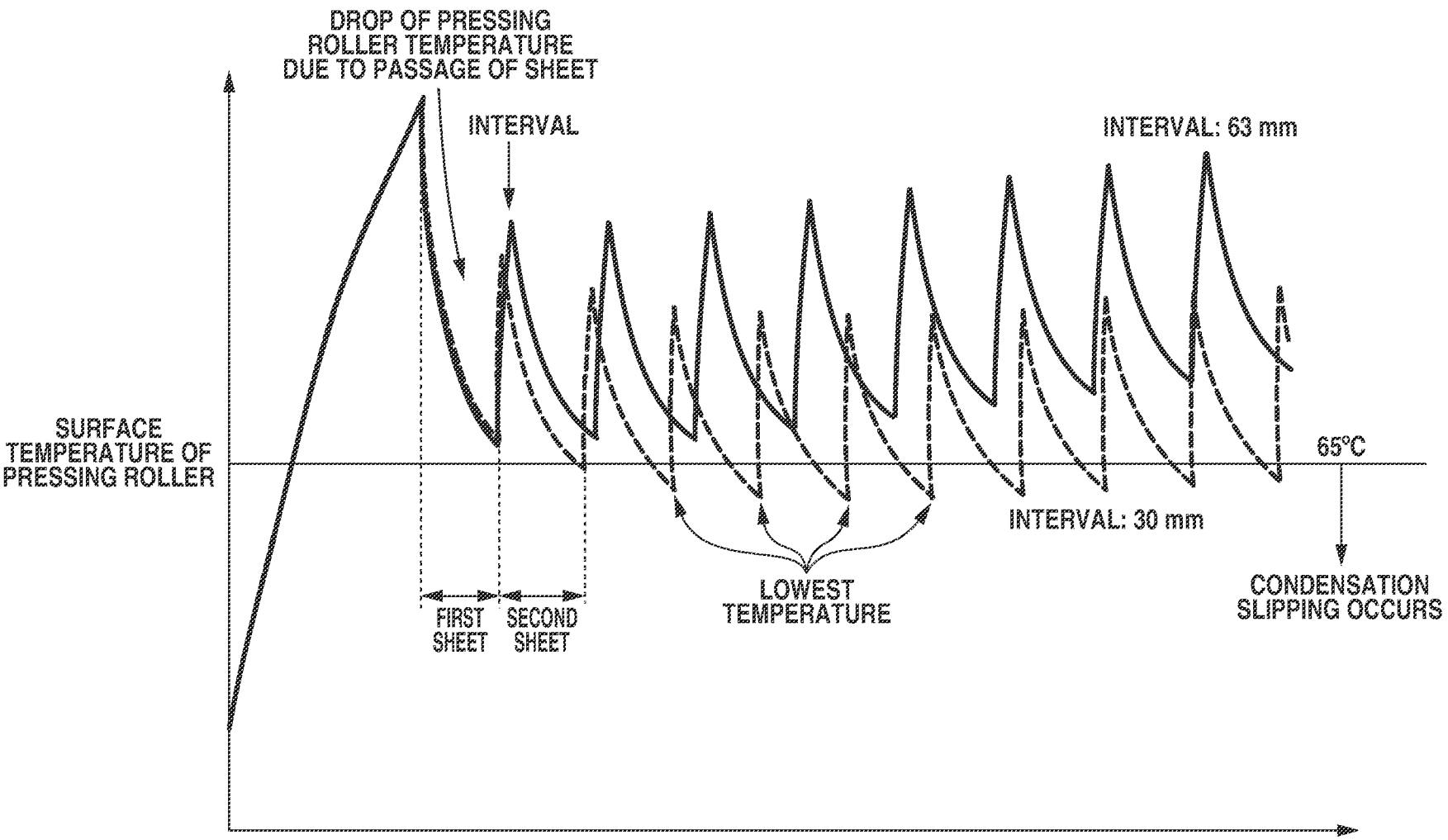
FIG. 2 is a diagram illustrating a transition of a surface temperature of a pressing roller.

FIG. 2 illustrates the transition of the pressing roller temperature when the continuous printing is performed from the state that the fixing unit 100 is cooled down. A dotted line indicates the pressing roller temperature when the interval is as short as 30 mm, and a solid line indicates the pressing roller temperature when the interval is equal to one cycle of the pressing roller 110 (63 mm). In either interval case, the pressing roller 110 is warmed until the first sheet reaches there, but the temperature considerably drops because the pressing roller 110 is deprived of heat by the sheet when the first sheet passes therethrough. Then, the temperature of the pressing roller 110 rises again at the interval, but drops again due to the passage of the next sheet.

At the time of the continuous printing, these temperature drops due to passage of sheets and temperature rises at the intervals are repeated, and whether the condensation occurs on the pressing roller 110 is determined based on the temperature to which the pressing roller temperature maximally drops (the lowest temperature in FIG. 2) due to passages of sheets. The pressing roller temperature at which the condensation slipping occurs varies depending on a difference in the speed, the pressing force, and other configurations, but, in the configuration according to the present exemplary embodiment, the condensation slipping occurs when the lowest temperature of the pressing roller 110 falls below 65° C. due to passage of sheets under an environment of 70% or higher in relative humidity regardless of the temperature. When the continuous printing is performed from the state that the fixing unit 100 is cooled down, the pressing roller temperature keeps rising at and after passage of the second sheet with the interval set to 63 mm which is equal to the length of the whole circumference of the pressing roller 110, while the temperature of the pressing roller 110 keeps dropping until five or six sheets pass therethrough and gradually turns to rise at and after the seventh sheet with the interval set to 30 mm. In the configuration according to the present exemplary embodiment, when the continuous printing is performed from the state that the fixing unit 100 is cooled down under the environment of 70% or higher in relative humidity, the interval set to 30 mm undesirably leads to an occurrence of the condensation slipping because the pressing roller temperature drops and the lowest temperature of the pressing roller 110 falls below 65° C. at and after the third sheet. On the other hand, the interval set to 63 mm, which is the length of the whole circumference of the pressing roller 110, is free from an occurrence of the condensation slipping because the pressing roller temperature is kept at 65° C. or higher without dropping.

When the continuous printing is performed from the state that the temperature of the temperature detection element 115 is 65° C. or lower, the configuration according to the present exemplary embodiment prevents the condensation slipping by widening the interval from 30 mm to 63 mm to raise the pressing roller temperature as described above. However, keeping widening the interval would impair productivity for the printed product.

Figure 3:
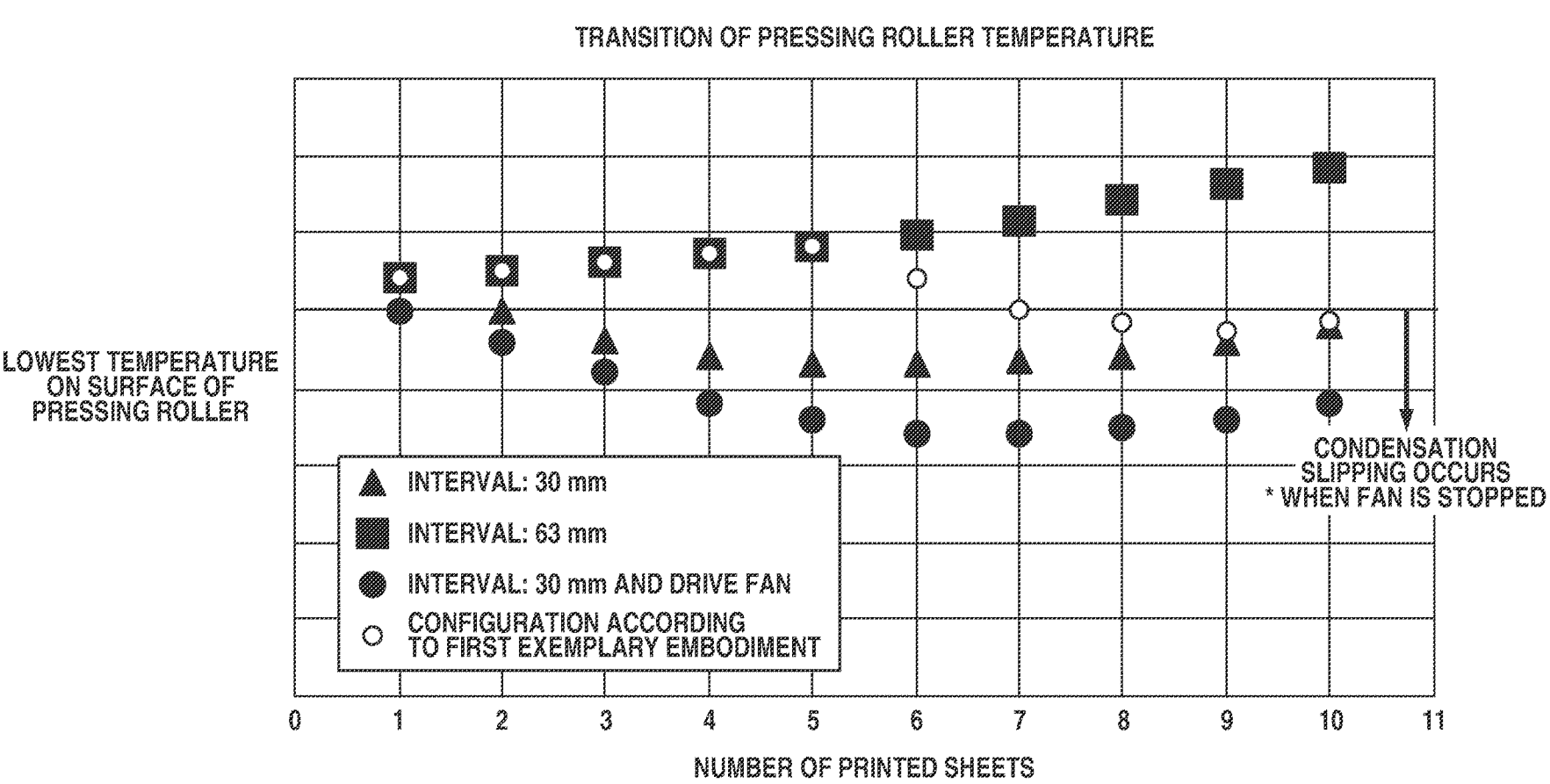
FIG. 3 is a diagram illustrating a transition of the lowest temperature on the surface of the pressing roller.

Thus, the present exemplary embodiment sets the interval to 63 mm until the fifth sheet (the interval between the fourth sheet and the fifth sheet), and narrows the interval at and after the sixth sheet to 30 mm and also rotates the fan, to improve productivity and prevent or reduce an occurrence of the condensation slipping and an increase in curling. FIG. 3 illustrates a transition of the lowest temperature of the pressing roller 110 when the continuous printing is performed from the state that the fixing unit 100 is cooled down, in each of the following four cases. The first case and the second case are examples when the interval is 30 mm and 63 mm, respectively (the fan is stopped in both the cases). The third case is an example when the interval is 30 mm and the fan is driven. The fourth case corresponds to the configuration according to the present exemplary embodiment, and is an example when the interval is set to 63 mm until the fifth sheet in the continuous printing, and then the interval is narrowed to 30 mm and the cooling fan 60 is driven at and after the sixth sheet.

Under the environment of 70% or higher in relative humidity, when the interval is set to 30 mm, the pressing roller temperature drops and the condensation slipping undesirably occurs at and after the third sheet at which the temperature reaches or falls below 65° C., as described above. On the other hand, when the interval is set to 63 mm, which corresponds to the length of the whole circumference of the pressing roller 110, the pressing roller temperature rises, and thus an occurrence of the condensation slipping can be prevented or reduced, but productivity for the printed product is impaired. If the cooling fan 60 is driven to prevent the condensation with the interval set to 30 mm, the pressing roller temperature drops, and consequently curling is increased as described above.

Since the configuration according to the present exemplary embodiment maintains the interval to the length corresponding to the whole circumference of the pressing roller 110 until the fifth sheet, the pressing roller temperature rises. Consequently, an occurrence of the condensation slipping is prevented or reduced and also an increase in curling is prevented or reduced. The productivity can be improved by narrowing the interval to 30 mm at and after the sixth sheet, but narrowing the interval leads to a drop of the pressing roller temperature. Since the water vapor amount in the image forming apparatus 50 increases due to the repetition of the heating fixing until the fifth sheet, the condensation starts on the pressing roller 110 if the pressing roller temperature drops. Therefore, the present exemplary embodiment prevents the condensation slipping by driving the fan at the same time as narrowing the interval. When the printing is continuously performed, if the sheet discharged onto the sheet discharge tray 45 first has a bad curl, the subsequent sheet is also curled up by the shape of the curl of the preceding sheet, and consequently curling is increased as a whole. Thus, raising the pressing roller temperature at the beginning of the printing, like the present exemplary embodiment, can prevent or reduce curling in the sheet discharged first, and consequently an increase in curling in the subsequent sheet can be prevented or reduced.

In sum, when the continuous printing is performed from the state that the fixing unit 100 is cooled down, the interval is widened at the beginning of the printing to warm the pressing roller 110, and then the fan is actuated and the interval is narrowed, whereby the condensation slipping and curling are prevented and reduced and also the productivity for the printed product can be secured.

(Advantageous Effects of Present Exemplary Embodiment)

A test was conducted to compare four cases illustrated in FIG. 3 in terms of condensation slipping, curling, and productivity for printed product under an environment of a high temperature and a high humidity that can cause an occurrence of the condensation slipping and the curling. A comparison test was conducted under an environment of temperature set to a room temperature of 30° C. and humidity set to 80%, and the results were compared after fifty halftone images at a printing ratio of 20% were continuously printed from the state that the fixing unit 100 was cooled down in each case. Sheets used in this test were Vitality Business 4200 (grammage 75 g/m$^2$) provided by Xerox Corporation that had been left under the environment of temperature set to the room temperature of 30° C. and humidity set to 80% for forty-eight hours. Whether the condensation slipping had occurred was determined based on whether the halftone image was distorted due to a delay in conveyance of the sheet because of a slip and whether a conveyance failure had occurred. The result was determined to be failed (fail) in a case where there was even only one sheet where the image was distorted due to the condensation slipping or a conveyance failure had occurred during printing of the fifty sheets, and determined to be passed (pass) in a case where there was not a single sheet where the image was defective or a conveyance failure had occurred during printing of the fifty sheets.

Figure 4:
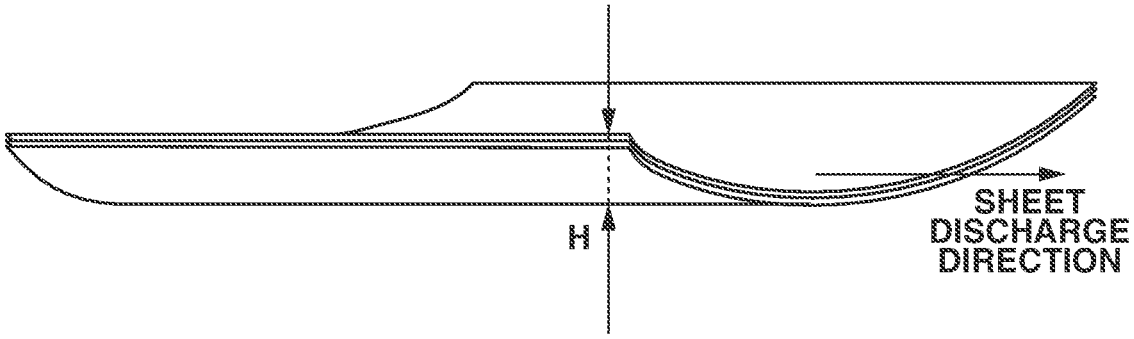
FIG. 4 is a diagram illustrating a method for measuring the amount of curling.

As illustrated in FIG. 4, the fifty sheets discharged onto the sheet discharge tray 45 after printing were placed on a flat floor, and a height H by which the sheets were curled from the floor was defined as the amount of curling. Productivity for the printed product was determined by measuring the time from when the first sheet was discharged onto the sheet discharge tray 45 until when the fiftieth sheet was discharged onto the sheet discharge tray 45 and defining it as the productivity. The following table indicates the test results of the example in which the interval was 30 mm, the example in which the interval was 63 mm equal to the length of the whole circumference of the pressing roller 110, the example having the configuration in which the interval was 30 mm and the fan was driven, and the example having the configuration in which the interval was 63 mm until the fifth sheet and then the interval was narrowed to 30 mm and the fan was driven at and after the sixth sheet, which was the configuration according to the present exemplary embodiment. The table 1 also includes cases of a second exemplary embodiment and a third exemplary embodiment, which will be described below.

TABLE 1

| | | Condensation Slipping | Curl | Productivity |
|---|---|---|---|---|
| Comparison Example 1 | Set the interval to 30 mm | Fail | 22 mm | 58.8 sec |
| Comparison Example 2 | Set the interval to 63 mm | Pass | 10 mm | 65.1 sec |
| Comparison Example 3 | Set the interval to 30 mm and drive the fan | Pass | 54 mm | 58.8 sec |
| First Exemplary Embodiment | Set the interval to 63 mm until the fifth sheet, and then set the interval to 30 mm and maximize the fan air volume at and after the sixth sheet | Pass | 14 mm | 59.3 sec |
| Second Exemplary Embodiment | Set the interval to 63 mm until the fifth sheet, and then set the interval to 30 mm and set the fan air volume to ⅓ at and after the sixth sheet | Pass | 11 mm | 59.3 sec |
| Third Exemplary Embodiment | Set the interval to 63 mm until the fifth sheet, and rotate the fan during one sheet for every three sheets at and after the sixth sheet | Pass | 11 mm | 59.3 sec |

In the comparison example 1, an image distortion due to the condensation slipping occurred on twenty-five sheets among the fifty sheets after the third sheet because the pressing roller temperature dropped. In the comparison example 2, no condensation slipping occurred because of the high pressing roller temperature and the amount of curling was low and excellent. However, it took time in terms of the productivity and printing of the fifty sheets was completed by six seconds or longer behind the time of the case where the interval was set to 30 mm. The comparison example 3 caused no condensation slipping because the water vapor around the pressing roller 110 were moved away, but the worst result was obtained in terms of the amount of curling because the temperature of the pressing roller 110 dropped.

According to the first exemplary embodiment, the amount of curling can be reduced by widening the interval at the beginning of the printing to warm the pressing roller 110, and a decrease in the productivity and the condensation slipping can be prevented or reduced by narrowing the interval and also driving the fan at and after the sixth sheet. In this manner, as the control according to the first exemplary embodiment, the following two periods are provided at the continuous printing in which toner images are formed on a plurality of continuously conveyed recording materials in the state that the surface temperature of the pressing roller 110 is lower than the predetermined temperature. One of them is a fan stop period in which the blower unit is stopped and the interval between the preceding recording material and the subsequent recording material is widened in the course of the continuous printing. The other of them is a fan operation period in which the blower unit is in operation and the interval is narrower than the interval in the fan stop period. The fan stop period is set to a period temporally prior to the fan operation period.

In this manner, when the continuous printing is performed from the state that the fixing unit 100 is cooled down, the condensation slipping and the curling can be prevented or reduced and also the productivity for printed product can be secured by widening the interval to warm the pressing roller 110 at the beginning of the printing, and actuating the fan and narrowing the interval after that.

In the following description, the second exemplary embodiment of the present disclosure will be described. The present exemplary embodiment is configured to widen the interval to warm the pressing roller at the beginning of the printing and actuate the fan and narrow the interval after that when the continuous printing is performed from the state that the fixing unit is cooled down, similarly to the first exemplary embodiment, and is characterized by being configured to reduce curling by reducing the air volume of the fan as much as possible. This will be described now.

In the present exemplary embodiment, the mechanical configuration of the image forming apparatus is similar to the first exemplary embodiment. Thus, similar members will be identified by the same reference numerals, and the redundant descriptions thereof will be omitted.

(Control of Fan according to Second Exemplary Embodiment)

The fan control unit 61 of the image forming apparatus according to the present exemplary embodiment is configured to be able to adjust the air volume output by the fan. Similarly to the first exemplary embodiment, the image forming apparatus according to the second exemplary embodiment also includes the cooling fan 60 to lower the temperatures of the cleaner 16 and the photosensitive drum 1 and to lower humidity around the fixing unit. When the printing operation is intermittently performed, the temperature of the photosensitive drum 1 rises due to friction of the cleaner 16 at the time of an idle rotation before sheet feeding or an idle rotation after discharging sheets. The temperatures of the cleaner 16 and the photosensitive drum 1 also easily rise due to the heat of the fixing unit. In the case of the continuous printing, because the idle rotation operation is performed only a small number of times and cooled sheets continuously pass therethrough, the photosensitive drum 1 is deprived of heat by the sheets and the temperature is difficult to rise. Thus, when the intermittent printing is repeated and the temperatures of the cleaner 16 and the photosensitive drum 1 rise, the cooling fan 60 is driven to prevent an occurrence of a cleaning failure and a development failure as described above. In this case, with the aim of cooling down the cleaner 16 and the photosensitive drum 1 as much as possible, the fan control unit 61 performs control of cooling them by maximizing the rotational speed of the cooling fan 60. The air volume of the cooling fan 60 is 0.12 msec toward the surface of the photosensitive drum 1 and 0.06 msec toward the surface of the pressing roller similarly to the first exemplary embodiment.

When the continuous printing is performed from the state that the image forming apparatus and the fixing unit are cooled down, the interval is widened until the fifth sheet to 63 mm equal to the length of the whole circumference of the pressing roller, and drives the cooling fan 60 at the same time as narrowing the interval to 30 mm at and after the sixth sheet, to prevent or reduce the condensation slipping and the curling, similarly to the first exemplary embodiment. According to the present exemplary embodiment, the curling is further reduced by rotating the cooling fan 60 at a smaller air volume at and after the sixth sheet than the air volume for cooling down the cleaner 16 and the photosensitive drum 1 having high temperatures. Since a drop of the temperature of the pressing roller can be prevented or reduced by reducing the air volume of the cooling fan 60 as much as possible to prevent an occurrence of the condensation slipping, the curling is reduced. In the present exemplary embodiment, an occurrence of the condensation slipping can be prevented or reduced in a case where air is applied to the surface of the pressing roller at the air volume of 0.02 msec or more. Thus, when the continuous printing is performed from the state that the fixing unit is cooled down, the air volume of the cooling fan 60 is controlled at and after the sixth sheet to one-third of the maximum air volume of the cooling fan 60 to apply 0.04 msec to the surface of the photosensitive drum 1 and 0.02 msec to the surface of the pressing roller. In this manner, the air volume of the blower unit during the fan operation period is set to a lower volume than the maximum air volume of the blower unit.

(Advantageous Effects of Present Exemplary Embodiment)

The above-described table 1 indicates the result of the second exemplary embodiment in terms of whether the condensation slipping had occurred, the amount of curling, and the productivity.

The configuration according to the present exemplary embodiment caused no condensation slipping, and reduced the amount of the curling more than the first exemplary embodiment while securing similar productivity to the first exemplary embodiment. The curling can be reduced by reducing the air volume of the cooling fan 60 to the degree of not causing the condensation slipping, like the present exemplary embodiment.

In the following description, the third exemplary embodiment of the present disclosure will be described. The second exemplary embodiment has been described regarding the configuration in which the air volume of the cooling fan 60 is reduced as much as possible to reduce the curling. The present exemplary embodiment achieves similar advantageous effects to the second exemplary embodiment by intermittently driving the fan. This will be described now.

According to the present exemplary embodiment, air is applied to the surface of the photosensitive drum at the air speed of 0.12 msec and to the surface of the pressing roller at the air speed of 0.06 msec when the fan is driven, similarly to the first exemplary embodiment. In the present exemplary embodiment, when the continuous printing is performed from the state that the fixing unit is cooled down, the interval is widened until the fifth sheet to 63 mm equal to the length of the whole circumference of the pressing roller, and then the fan is driven at the same time as narrowing the interval to 30 mm at and after the sixth sheet, to prevent or reduce the condensation slipping and the curling, similarly to the first and second exemplary embodiments. However, in the present exemplary embodiment reduces the curling similarly to the second exemplary embodiment by driving the fan intermittently at and after the sixth sheet.

Figure 5:
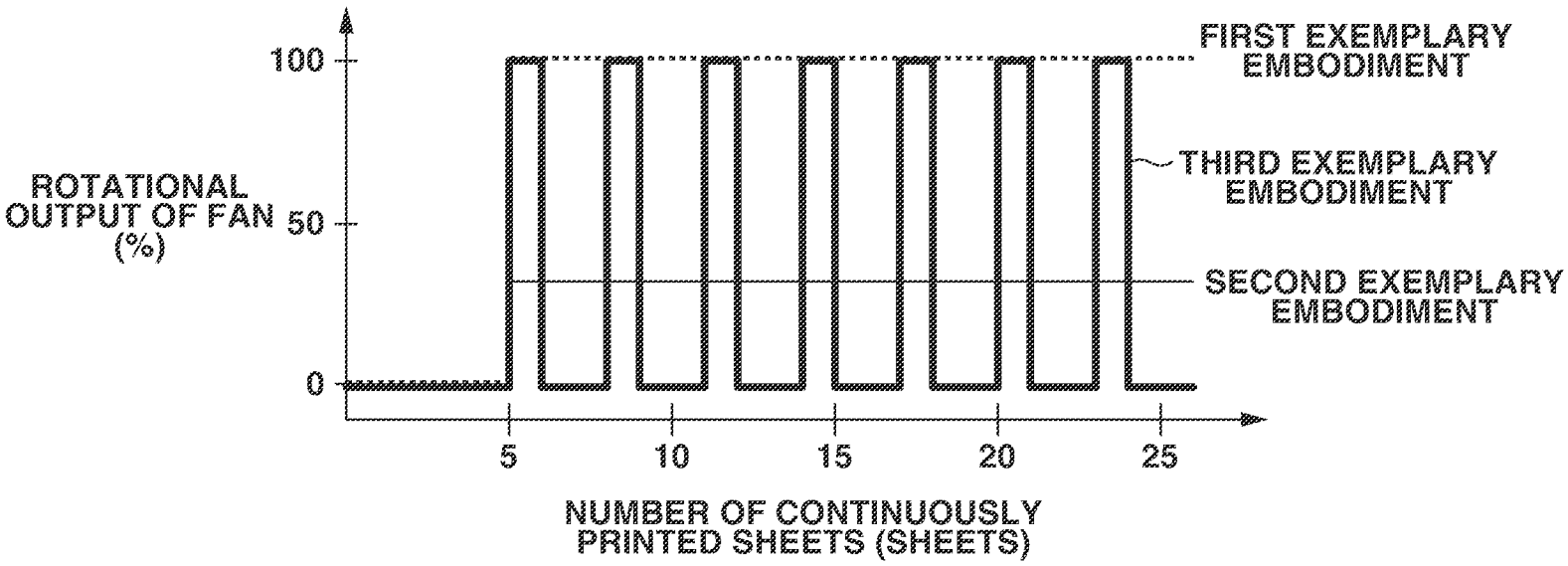
FIG. 5 is a diagram illustrating a transition of control of driving a fan.

FIG. 5 illustrates transition of a rotational output of the fan according to each of the first to third exemplary embodiments. While the first exemplary embodiment (a dotted line) rotates the fan at a 100% output at and after the sixth sheet, the second exemplary embodiment (a thin solid line) controls and reduces the air volume of the fan to one-third to reduce the curling. The third exemplary embodiment (a thick solid line) rotates the fan at and after the sixth sheet similarly to the first exemplary embodiment, but stops driving the fan for the two seventh and eighth sheets after rotating the fan only during passage of one sheet. Then, the third exemplary embodiment repeats the control of rotating the fan at a 100% output only during passage of one sheet for every three sheets and stopping the fan for the remaining two sheets at and after the ninth sheet similarly to the sixth to eighth sheets, which allows the air volume as a whole to reduce to one-third of the first exemplary embodiment, similarly to the second exemplary embodiment. In this manner, the operation of the blower unit during the fan operation period is an intermittent operation.

(Advantageous Effects of the Present Exemplary Embodiment)

The above-described table 1 indicates the result of the third exemplary embodiment in terms of whether the condensation slipping had occurred, the amount of curling, and the productivity.

The present exemplary embodiment also caused no condensation slipping, and reduced the amount of curling equivalently to the second exemplary embodiment while securing similar productivity to the first exemplary embodiment. The curling can be reduced by intermittently controlling the air volume of the fan to reduce the air volume as a whole to the degree of not causing the condensation slipping, like the present exemplary embodiment.

The configurations described in the first to third exemplary embodiments perform the control in which the interval at the beginning of the printing is widened to 63 mm equal to the length of the whole circumference of the pressing roller, when the continuous printing is performed from the state that the fixing unit is cooled down. In the configuration, the control of narrowing the interval at and after the sixth sheet is also performed. However, the interval is not limited to this numerical value, and can be effectively set by optimally adjusting the widened interval and the timing according to the diameter of the pressing roller, the temperature of the pressing roller, the humidity around the pressing roller, and the like.

For example, in a case where non-foamed solid silicon rubber is used as the configuration of the pressing roller, such a pressing roller is high in heat capacity and has difficulty in raising the temperature on the surface of the pressing roller. In this case, the interval at the beginning of the continuous printing may be set to a further wide interval.

The timing of narrowing the interval is also not limited to the sixth sheet, and can be effectively set by adjusting it according to the configuration of the fixing unit, such as the heat capacity of the pressing roller. In a case where the continuous printing continues, the condensation slipping no longer occurs since the pressing roller temperature rises, and thus the fan rotated according to the pressing roller temperature may be stopped. Stopping the fan can further raise the pressing roller temperature, whereby a decrease in curling and smoothness of stacking can be improved.

Because no condensation slipping occurs when air is applied to the surface of the pressing roller at the air volume of 0.02 msec or more in the configuration of the fixing unit illustrated in FIG. 1, the air volume is set to one-third of the maximum air volume of the fan (the air volume of 0.06 msec for the pressing roller) in the second exemplary embodiment and the third exemplary embodiment, but is not limited thereto. The air volume applied to the pressing roller varies depending on not only the capability of the fan and the design of the air path from the fan to the pressing roller but also the type of toner in use. A difference in the melting point of toner also leads to a difference in the temperature at which a sheet is subjected to the heating fixing, and also leads to a difference in the amount of water vapor from the sheet. Since the humidity around the pressing roller varies and the air volume for not causing the condensation slipping also varies according to the amount of water vapor from the sheet, the air volume can be effectively set by optimizing it to prevent or reduce the condensation slipping according to the toner and the configuration of the fan, and the configuration of the fixing unit.

The description is given of the configuration of the image forming apparatus 50 in which cooling the cleaner 16 and the photosensitive drum 1 and dehumidifying the fixing unit is performed using one fan, but a fan dedicated for dehumidifying the fixing unit may be disposed. Since such a configuration allows dehumidification control to be performed independently of the cooling of the cleaner 16 and the photosensitive drum 1, the dehumidification of the fixing unit can be appropriately controlled. The condensation slipping unlikely occurs under a low-humidity environment, and thus the low-humidity environment under which no condensation slipping occurs can be detected by providing a humidity sensor that detects an external humidity to the image forming apparatus. Accordingly, such a configuration allows the control according to the present exemplary embodiments to be applied as necessary.

The above-described image forming apparatus has been described based on the monochrome configuration, but similar advantageous effects can also be acquired even when the configuration according to the present exemplary embodiments is applied to a color image forming apparatus that prints an image by superimposing a plurality of colors, such as yellow, magenta, cyan, and black.

According to the present disclosure, it is possible to provide an image forming apparatus capable of preventing or reducing a failure in conveyance of a recording material due to condensation on a pressing roller and also preventing or reducing curling in the recording material.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus for forming a toner image on a recording material, the image forming apparatus comprising:

a fixing unit including a first rotatable member, a heating member configured to heat the first rotatable member, and a second rotatable member configured to form a fixing nip portion together with the first rotatable member, and configured to heat and fix the toner image formed on the recording material at the fixing nip portion;

a blower unit configured to blow air around the second rotatable member; and a temperature detection unit configured to detect a temperature of the fixing unit, wherein an interval when a print operation is started is a first interval in a case where a temperature detected by the temperature detection unit when the print operation is started is a first temperature, and the interval when the print operation is started is a second interval in a case where the temperature detected by the temperature detection unit when the print operation is started is a second temperature, wherein the interval is an interval between a preceding recording material and a recording material subsequent to the preceding recording material, wherein the first temperature is a predetermined temperature or higher, and the second temperature is lower than the predetermined temperature, wherein the second interval is wider than the first interval, and wherein the blower unit is operated during the print operation in a case where the print operation is performed at the first interval, and the blower unit is not operated during the print operation in a case where the print operation is performed at the second interval.

2. The image forming apparatus according to claim 1, wherein a period after a first period is set to be a second period in a case where continuous printing, in which a toner image is formed on a plurality of sheets of the recording material conveyed successively, is performed, wherein, in the case where the temperature detected by the temperature detection unit is the second temperature, the interval of the first period is set to be the second interval, and the interval of the second period is set to be a third interval, and wherein the third interval is narrower than the second interval.

3. The image forming apparatus according to claim 2, wherein an air volume of the blower unit during the second period is set to a lower volume than a maximum air volume of the blower unit.

4. The image forming apparatus according to claim 2, wherein an operation of the blower unit during the second period is an intermittent operation.

5. The image forming apparatus according to claim 1, wherein a period after a first period is set to be a second period in a case where continuous printing, in which a toner image is formed on a plurality of sheets of the recording material conveyed successively, is performed, and wherein, in the case where the temperature detected by the temperature detection unit is the first temperature, the interval of the first period is set to be the first interval, and the interval of the second period is set to be the first interval.

6. The image forming apparatus according to claim 1, wherein the heating member includes a heater that is in contact with an inner surface of the first rotatable member.

7. The image forming apparatus according to claim 1, wherein the first rotatable member is a film, wherein the heating member is disposed in an inner space of film, wherein the second rotatable member is a pressing roller, and wherein the pressing roller forms the fixing nip portion together with the heating member via the film.

8. The image forming apparatus according to claim 1, further comprising:

an image bearing member; and a transfer unit configured to transfer a toner image formed on the image bearing member onto the recording material, wherein the blower unit is disposed between the transfer unit and the fixing unit in a direction of a height of the image forming apparatus when viewed in a direction of an axis of the second rotatable member.

9. The image forming apparatus according to claim 8, wherein, in a case where one part of a conveyance path for conveying the recording material from the transfer unit to the fixing unit is a first region and an other part of the conveyance path is a second region, the blower unit is disposed in the first region and the image bearing member is disposed in the second region.

10. An image forming apparatus for forming a toner image on a recording material, the image forming apparatus comprising:

a fixing unit including a first rotatable member, a heating member configured to heat the first rotatable member, and a second rotatable member forming a fixing nip portion together with the first rotatable member, and configured to heat and fix the toner image formed on the recording material at the fixing nip portion; and a blower unit configured to blow air around the second rotatable member, wherein, at continuous printing for forming a toner image on a plurality of recording materials continuously conveyed, a second section follows a first section, wherein, in the first section, the blower unit is not operated and an interval between a preceding recording material and a succeeding recording material is a first distance, wherein, in the second section, the blower unit is operated and the interval is a second distance narrower than the first distance, and wherein a temperature of the second rotatable member in the second section is higher than a temperature of the second rotatable member in the first section.

11. The image forming apparatus according to claim 10, wherein the first section is set in a case where a surface temperature of the second rotatable member is lower than a predetermined temperature when the continuous printing is started.

12. The image forming apparatus according to claim 10, wherein an air volume of the blower unit during a second period is set to a lower volume than a maximum air volume of the blower unit.

13. The image forming apparatus according to claim 10, wherein an operation of the blower unit during a second period is an intermittent operation.

14. The image forming apparatus according to claim 10, wherein, in a case where a surface temperature of the second rotatable member exceeds a predetermined temperature due to the continuous printing, the blower unit is stopped.

15. The image forming apparatus according to claim 10, wherein, in a case where a humidity is lower than a predetermined humidity, the blower unit is not actuated and the interval is not changed at the continuous printing.

16. The image forming apparatus according to claim 10, wherein the heating member includes a heater that is in contact with an inner surface of the first rotatable member.

17. The image forming apparatus according to claim 10, wherein the first rotatable member is a film, wherein the heating member is disposed in an inner space of the film, wherein the second rotatable member is a pressing roller, and wherein the pressing roller forms the fixing nip portion together with the heating member via the film.

18. The image forming apparatus according to claim 10, further comprising:

an image bearing member; and a transfer unit configured to transfer a toner image formed on the image bearing member onto the recording material, wherein the blower unit is disposed between the transfer unit and the fixing unit in a direction of a height of the image forming apparatus when viewed in a direction of an axis of the second rotatable member.

19. The image forming apparatus according to claim 18, wherein, in a case where one part of a conveyance path for conveying the recording material from the transfer unit to the fixing unit is a first region and an other part of the conveyance path is a second region, the blower unit is disposed in the first region and the image bearing member is disposed in the second region.

20. The image forming apparatus according to claim 19, wherein the first section is set in a case where a surface temperature of the second rotatable member is lower than a predetermined temperature when the continuous printing is started.

21. The image forming apparatus according to claim 19, wherein an air volume of the blower unit during a second period is set to a lower volume than a maximum air volume of the blower unit.

22. The image forming apparatus according to claim 19, wherein an operation of the blower unit during a second period is an intermittent operation.

23. The image forming apparatus according to claim 19, wherein, in a case where a surface temperature of the second rotatable member exceeds a predetermined temperature due to the continuous printing, the blower unit is stopped.

24. The image forming apparatus according to claim 19, wherein, in a case where a humidity is lower than a predetermined humidity, the blower unit is not actuated and the interval is not changed at the continuous printing.

25. The image forming apparatus according to claim 19, wherein the heating member includes a heater that is in contact with an inner surface of the first rotatable member.

26. The image forming apparatus according to claim 19, wherein the first rotatable member is a film, wherein the heating member is disposed in an inner space of the film, wherein the second rotatable member is a pressing roller, and wherein the pressing roller forms the fixing nip portion together with the heating member via the film.

27. An image forming apparatus for forming a toner image on a recording material, the image forming apparatus comprising:

an image bearing member;

a transfer unit configured to transfer a toner image formed on the image bearing member onto the recording material;

a fixing unit including a first rotatable member, a heating member configured to heat the first rotatable member, and a second rotatable member forming a fixing nip portion together with the first rotatable member, and configured to heat and fix the toner image formed on the recording material at the fixing nip portion; and a blower unit configured to blow air around the second rotatable member, wherein, at continuous printing for forming a toner image on a plurality of recording materials continuously conveyed, a second section follows a first section, wherein, in the first section, an interval between a preceding recording material and a succeeding recording material is a first distance, wherein, in the second section, the blower unit is operated and the interval is a second distance narrower than the first distance, and wherein the blower unit is disposed between the transfer unit and the fixing unit in a direction of a height of the image forming apparatus when viewed in a direction of an axis of the second rotatable member.

28. The image forming apparatus according to claim 27, wherein the blower unit is disposed between the transfer unit and the fixing unit in a direction of a height of the image forming apparatus when viewed in a direction of an axis of the second rotatable member.

* * * * *